US006186860B1

(12) United States Patent
Liao

(10) Patent No.: US 6,186,860 B1
(45) Date of Patent: Feb. 13, 2001

(54) KNOCKDOWN BLOCK TOY

(76) Inventor: Chu-Yuan Liao, 5F-1, No. 177 Sec. 1 Ho-Ping E. Rd., Taipei (TW)

( * ) Notice: Under 35 U.S.C. 154(b), the term of this patent shall be extended for 0 days.

(21) Appl. No.: 09/452,192

(22) Filed: Dec. 2, 1999

(51) Int. Cl.[7] ..... A63F 9/08

(52) U.S. Cl. ..... 446/486; 446/71; 446/267; 273/153 S; 482/44

(58) Field of Search ..... 446/487, 4, 5, 446/69, 71, 267, 486; 273/153 S, 157 A; 482/44

(56) References Cited

U.S. PATENT DOCUMENTS 4,036,503 * 7/1977 Golick ..... 273/153 S
4,488,725 * 12/1984 Clark ..... 273/153 S
4,685,665 * 8/1987 Carlisle ..... 482/44
5,090,700 * 2/1992 Toukomies ..... 273/153 S
5,116,052 * 5/1992 Pop ..... 273/153 R
5,145,473 * 9/1992 Henry ..... 482/44 X
5,310,183 * 5/1994 Glikmann ..... 273/153 S
5,451,055 * 9/1995 Lo ..... 273/113
5,577,723 * 11/1996 DiResta et al. ..... 446/267 X
5,839,992 * 11/1998 Phillips ..... 482/49
5,845,904 * 12/1998 Hawkins ..... 273/153 R
5,857,673 * 1/1999 Ablonczy et al. ..... 273/153
5,890,999 * 4/1999 Kildani ..... 482/44 X
5,891,000 * 4/1999 Phillips ..... 482/49
5,924,692 * 7/1999 Rosenberg ..... 273/153 S

* cited by examiner

*Primary Examiner*—John A. Ricci
(74) *Attorney, Agent, or Firm*—Dougherty & Troxell

(57) ABSTRACT

A knockdown block toy including a soft extensible outer envelope body and a predetermined number of component blocks contained in the outer envelope body. The outer envelope body softly encloses the component blocks therein, whereby when the knockdown block assembly is squeezed and compressed or pushed by external force, the component blocks are displaced within the outer envelope body relative to each other and re-assembled and stacked to form various patterns of assemblies as desired.

6 Claims, 3 Drawing Sheets

KNOCKDOWN BLOCK TOY

BACKGROUND OF THE INVENTION

The present invention relates to a knockdown block toy, and more particularly to a knockdown block toy including a soft extensible plastic outer envelope body and a predetermined number of component blocks contained in the outer envelope body. The outer envelope body softly encloses the component blocks therein, whereby when the knockdown block assembly is squeezed and compressed or pushed by external force, the component blocks are displaced within the outer envelope body relative to each other and re-assembled and stacked to form various patterns of assemblies as desired and provide novel and funny entertaining effect.

FIG. 1 shows a conventional knockdown cubic block toy. Such toy is composed of multiple cubic blocks 11 assembled with a movable cross-shaped frame to form a solid assembly which can be repeatedly rotated in multiple directions. The cubic blocks 11 of the assembly 1 are printed with or overlaid with several colors or different pictures. When playing the cubic block toy, the respective cubic blocks 11 of the assembly are rotated in accordance with the colors or the pictures to together form a predetermined aspect. Such procedure is intellectual and funny. However, due to the limitation of the fixed pattern of the cross-shaped frame, the cubic blocks 11 cannot be disassembled to form other solid configurations. Therefore, once assembled, the cubic blocks 11 have a fixed aspect and cannot be changed in pattern. Therefore, such a cubic block toy is monotonous and can hardly provide a novel entertaining effect.

SUMMARY OF THE INVENTION

It is therefore a primary object of the present invention to provide a knockdown block toy, and more particularly to a knockdown block toy including a soft extensible plastic outer envelope body and a predetermined number of component blocks contained in the outer envelope body. The component blocks are softly enclosed within the outer envelope body and stacked on each other. When the knockdown block assembly is squeezed and compressed or pushed by hand, the component blocks are displaced within the outer envelope body relative to each other and re-assembled and stacked to form various patterns of assemblies as desired.

It is a further object of the present invention to provide the above knockdown block toy in which the outer envelope body is equipped with a fitting section for a key ring or a chain to hang or hook thereon, permitting a user to carry keys with the toy as a decoration.

The present invention can be best understood through the following description and accompanying drawings wherein:

DETAILED DESCRIPTION OF THE PREFERRED EMBODIMENTS

Figure 1:
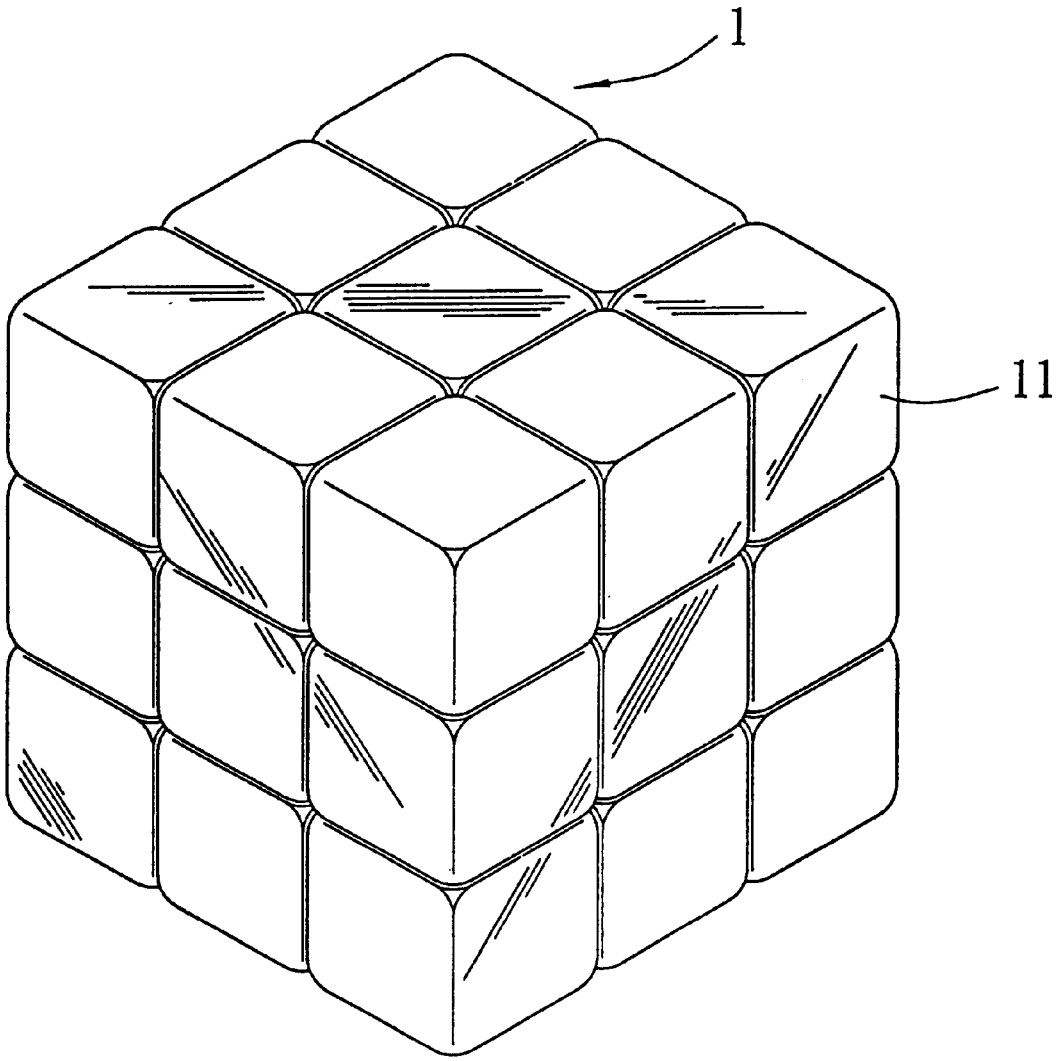
Fig. 1 (Prior Art)
FIG. 1 is a perspective view of a conventional knockdown cubic block toy.
Figure 2:
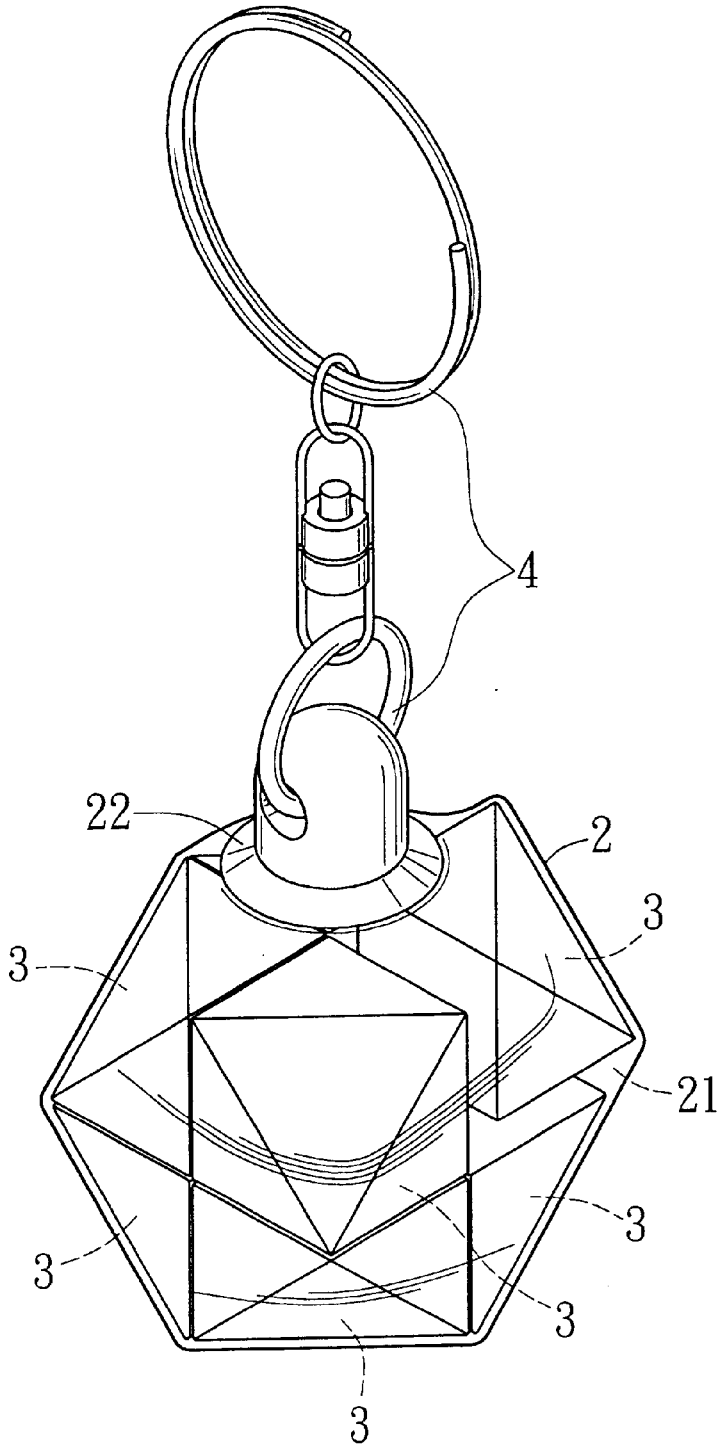
FIG. 2 is a perspective view of the knockdown block toy of the present invention.
Figure 3:
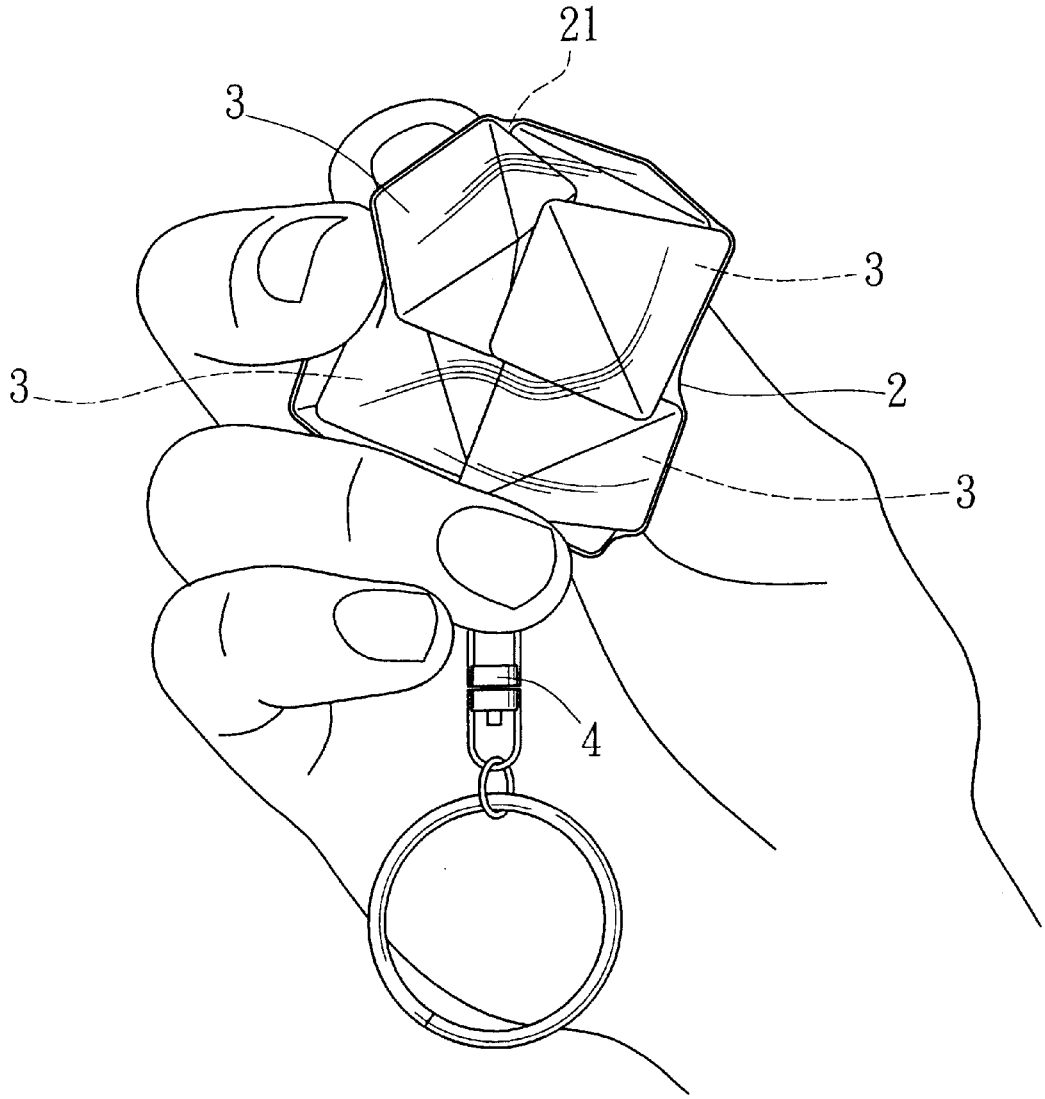
FIG. 3 shows the playing of the knockdown block toy of the present invention.

Please refer to FIG. 2. The knockdown block toy of the present invention includes an outer envelope body 2 made of soft extensible plastic layer. A predetermined number of component blocks 3 are contained in the interior 21 of the outer envelope body 2. The component blocks 3 are softly enclosed by the outer envelope body 2 and assembled in a stacked pattern. The outer envelope body 2 is extensible so that when the assembly is stretched or compressed by an external force, the entire body can be deformed to form various stacked patterns of assemblies as desired. The respective component blocks 3 are only limited within the outer envelope body 2 without other limitation in movement so that they can more freely be re-assembled in a versatile manner than the conventional knockdown cubic block toy. In addition, the outer envelope body 2 can be equipped with a fitting section 22 for a key ring 4 or a chain to hang or hook thereon, permitting a user to carry keys with the toy as a decoration.

Moreover, in order to enhance the movability of the component blocks 3 within the outer envelope body 2 relative to each other, a lubricant (such as water, oil or other liquid lubricant) can be filled into the outer envelope body 2 so as to help in re-assembling of the component blocks.

According to the above arrangement, when the knockdown block assembly of the present invention is pushed and compressed, the assembly can be stretched and deformed to form various stacked patterns of assemblies so as to create novel entertaining effect.

The above embodiment is only used to illustrate the present invention, not intended to limit the scope thereof. Many modifications of the above embodiment can be made without departing from the spirit of the present invention.

What is claimed is:

1. A knockdown block toy comprising:

a) a plurality of interfitting blocks arrangeable in a plurality of different patterns; and, b) an envelope body of soft, extensible material completely surrounding the plurality of interfitting blocks so as to hold the blocks in one of the plurality of patterns, whereby deformation of the envelope body enables the plurality of blocks to be rearranged in a different desired pattern.

2. The knockdown block toy of claim 1 further comprising a keyring attached to the envelope body.

3. The knockdown block toy of claim 1 further comprising a liquid filling the envelope body.

4. The knockdown block toy of claim 3 wherein the liquid comprises water.

5. The knockdown block toy of claim 3 wherein the liquid comprises oil.

6. The knockdown block toy of claim 3 wherein the liquid comprises a lubricant.

* * * * *